US005893659A

United States Patent [19]

Nanjo et al.

[11] Patent Number: 5,893,659

[45] Date of Patent: Apr. 13, 1999

[54] IMAGE FORMING APPARATUS WITH TRANSFER CURRENT CONTROLLER AND METHOD OF FORMING AN IMAGE USING THE SAME

[75] Inventors: Yuzuru Nanjo; Ryuji Wataki; Yukihiro Aikawa; Shigeo Fujita, all of Osaka, Japan

[73] Assignee: Mita Industrial Co., Ltd., Osaka-fu, Japan

[21] Appl. No.: 09/005,464

[22] Filed: Jan. 12, 1998

[30] Foreign Application Priority Data

Jan. 17, 1997 [JP] Japan ..... 9-006127
Oct. 24, 1997 [JP] Japan ..... 9-292981

[51] Int. Cl.[6] ..... G03G 15/00; G03G 15/16

[52] U.S. Cl. ..... 399/48; 399/66; 399/297

[58] Field of Search ..... 399/48, 46, 66, 399/76, 297, 298, 300–305, 308–317

[56] References Cited

U.S. PATENT DOCUMENTS 4,643,561 2/1987 Folkins ..... 355/14
5,515,146 5/1996 Harasawa et al. ..... 355/271

FOREIGN PATENT DOCUMENTS 61-14671 1/1986 Japan .

*Primary Examiner*—Richard Moses
*Assistant Examiner*—Shival Virmani
*Attorney, Agent, or Firm*—Jordan & Hamburg LLP

[57] ABSTRACT

This invention relates to an image forming apparatus with a transfer unit for transferring toner electrically to an electrostatic latent image formed on a photoreceptor onto a copy sheet. The image forming apparatus has a transfer electrode charge supply means for supplying electric charges to a transfer electrode provided in the transfer unit to electrically attract the toner onto the copy sheet and control means for controlling the quantity of electric charges to be supplied to the photoreceptor via the transfer electrode from the transfer electrode charge supply means based on a photoreceptor inflow current flowing to the photoreceptor through the charge send/receive means and on a photoreceptor outflow current flowing out from the photoreceptor through a ground wire connecting the photoreceptor and the ground. The charge send/receive means, other than the transfer unit, sends and receives electric charges to and from the photoreceptor. With this arrangement, variation of photoreceptor inflow current due to image density variation of an original document can be controlled to perform a stable image transfer.

18 Claims, 4 Drawing Sheets

IMAGE FORMING APPARATUS WITH TRANSFER CURRENT CONTROLLER AND METHOD OF FORMING AN IMAGE USING THE SAME

BACKGROUND OF THE INVENTION

1. Field of the Invention

This invention relates to an image forming apparatus and a method for forming an image using the same, and more particularly to an image forming apparatus that enables stable image transfer with enhanced transferability by detecting an electric current (hereinafter simply referred to as current) derived in a transfer unit based on a summation of inflow and outflow of current to and from a photoreceptor as a whole, and a method for forming an image using such image forming apparatus.

2. Description of the Background Art

Generally, there have been known various electrophotography type image forming apparatuses such as copying machines, facsimile machines and printers provided with transfer units as an essential part in which toner is electrically attracted to an electrostatic latent image formed on the surface of a photoreceptor 1 to develop latent image into a toner image and the toner image is electrically attracted to a copy sheet to transfer the toner image thereto. One of such conventional image forming apparatuses is schematically shown in FIG. 3.

As shown in FIG. 3, the image forming apparatus A3 comprises a charging unit 2 for uniformly charging the surface of a photoreceptor (hereinafter merely referred to as a "main charger"), a developing unit 3 for developing an electrostatic latent image, formed on the photoreceptor surface through projection of light that has been modulated based on image data, into a toner image by electrically attracting toner to the latent image, a power supply 5 for supplying electric charges, i.e., applying a certain voltage to a transfer roller 4 in a transfer unit C provided at an appropriate position over the outer circumference of the photoreceptor 1 to electrically attract the toner image to a copy sheet transported to the transfer unit C to transfer the toner image thereto, and a cleaning unit 6 for removing toner residues from the surface of the photoreceptor 1 after the image transfer by the transfer unit C.

More specifically, the main charger 2 includes a U-shaped casing member (shielding member) 2*a*, a wire electrode 2*b* made of a metallic material such as tungsten, a power supply (or battery) 2*c* for applying a voltage of several K-volts to the electrode 2*b*, and bias voltage means 2*d* for applying a bias voltage to the casing member 2*a*.

The photoreceptor 1 is grounded, and when the power supply 2*c* applies a certain high voltage to the electrode 2*b*, corona discharge generates between the wire electrode 2*b* and the photoreceptor 1 to uniformly charge the photoreceptor surface at a positive potential level. It is to be noted that the corona discharge generates over the outer surface of the photoreceptor 1, which is in the form of a drum, since the bias voltage means 2*d* applies a certain bias voltage to the shielding member 2*a*.

When the uniformly positively charged surface of the photoreceptor 1 is exposed to projection of light that has been modulated based on image data, the electric resistance on the photoreceptor surface at the exposed area varies according to the intensity level of modulated light, thereby forming an electrostatic latent image on the exposed area on the photoreceptor surface.

Meanwhile, negatively charged toner is electrically attracted to the electrostatic latent image by a developing roller 3*b* of the developing unit 3 drives by power supply 3*a* to develop the latent image into a toner image.

Also, electric charges of the power supply 5 are supplied to a copy sheet that has been transported to the transfer unit C by the transfer roller 4 to transfer the toner image onto the statically charged copy sheet (to effect image transfer).

After the image transfer by the transfer unit C, the cleaning unit 6 removes toner residues on the surface of the photoreceptor mechanically and with the use of electrical attraction force of the power 6*a*.

There has been proposed an idea of incorporating a controller in the above image forming apparatus A3, as disclosed in Japanese Unexamined Patent Publication No. SHO 61-14670. In this publication, the controller indicated by the symbol M in FIG. 3 for controlling a current established in the transfer unit C (hereinafter merely referred to as "transfer current") resulting from inflow and outflow of current, is provided to prevent deterioration of transferability due to change of humidity in the atmospheric air.

It is a well known phenomenon that when the humidity in the atmospheric air rises, moisture absorption of copy sheet is raised, which in turn, lowers its electric resistance. As a result, electric charges supplied to the transfer roller 4 through the copy sheet of low electric resistance during an image transfer and escape to peripheral members around the transfer roller 4, such as guide means for guiding the copy sheet. Thus, rise of humidity lowers image transferability and hence obstructs realization of desirable density of transferred image.

Considering the above phenomenon, the image forming apparatus provided with the controller M is effective when used with copy sheets of low electric resistance (i.e., in a state of high moisture absorption).

Referring back to FIG. 3, the controller M is arranged at a specified position in a ground wire 7 connecting the photoreceptor 1 to the ground to control the transfer current in a predetermined range, and comprises photoreceptor outflow current detector means 8 for detecting a current flowing from the photoreceptor 1 to the ground wire 7 and transfer current control means 19 for controlling output of the power 5 based on a measurement result by the detector means 8.

The controller M causes the outflow current detector means 8 to monitor the current flowing from the photoreceptor 1 and feed-backs to the power supply 5 so as to set the difference between currents in the presence and in the absence of copy sheet in the transfer unit C, as a control value (target value) for controlling the output of the power 5.

However, it is to be noted that the photoreceptor 1 is subject to inflows and outflows of current—besides the transfer current—through other electric charge send/receive means (hereinafter referred to as charge SND/RCV means) such as the developing unit 3 and the cleaning unit 6. Accordingly, in the arrangement of the apparatus A3 in which the change rate or value of transfer current is estimated by merely monitoring the change of photoreceptor outflow current from the photoreceptor 1, the accurate transfer current cannot be detected, resulting in hindrance against desirable control of output of the power supply 5. One of such drawbacks is described with reference to the graph in FIG. 4.

FIG. 4 is a graph showing how the current flowing into the photoreceptor 1 from charge send/receive means (such as the developing unit 3 and the cleaning unit 6) varies according to the state (density-white or black) of an original document image when the surface of the photoreceptor 1 is positively charged and negatively charged toner is attracted to a latent image on the photoreceptor surface.

Specifically, in the case where the original document has no image, i.e., is all white, the negatively charged toner is hardly attracted to the photoreceptor 1, resulting in no or insignificant change of current due to electrical attraction of toner. Since the main charger 2 is positively charged and the photoreceptor 1 is grounded, a current $I_{mc}$ shown in FIGS. 3 & 4 flows to the photoreceptor 1 from the main charger 2.

On the other hand, if the original document image is all black (high image density), a great amount of negatively charged toner moves toward the positively charged photoreceptor surface from the developing unit 3, thus remarkably reducing the current $I_{dev}$ (indicated by the arrow ← in FIG. 3) flowing into the photoreceptor $I_{dev}$ from the developing unit 3. Also, the current flowing from the photoreceptor 1 to the cleaning unit 6 increases since the potential of photoreceptor 1 becomes high in the case of transferring image of high density, which, in turn, remarkably decreases a resultant current $I_{cl}$ (indicated by the arrow → in FIG. 3) that flows from the cleaning unit 6 to the photoreceptor 1.

In this way, despite the fact that the transfer current $I_t$ increases as a whole due to decrease of currents such as $I_{cl}$ and $I_{dev}$ when the original document image of high density is to be transferred, the conventional image forming apparatus A3 attempts to control the transfer current $I_t$ simply based on the photoreceptor outflow current $I_{pc}$ flowing from the photoreceptor 1 through the ground wire 7. However, such control is not feasible as FIG. 4 clearly illustrates the situation in which the image density of the original document changes. Accordingly, an attempt to control the transfer current $I_t$ based on the photoreceptor outflow current $I_{pc}$ alone results in partial incapability or deterioration of image transfer and a hindrance against a stable image transfer.

SUMMARY OF THE INVENTION

In view of the above drawbacks of the prior art, an object of this invention is to provide an image forming apparatus that enables stable image transfer with enhanced transferability even if a density of an original document image varies by controlling a transfer current established in a transfer unit on the basis of summation of inflow and outflow currents flowing to and from a photoreceptor.

To accomplish the above object, this invention is directed to an image forming apparatus with a transfer unit for transferring toner electrically attracted to an electrostatic latent image formed on a photoreceptor onto a copy sheet, the image forming apparatus comprises: the transfer unit including a transfer electrode; charge send/receive means, other than the transfer unit, for sending and receiving electric charges to and from the photoreceptor; a transfer electrode charge supply means for supplying electric charges to the transfer electrode to electrically attract the toner onto the copy sheet; and control means for controlling electric charges to be supplied to the photoreceptor via the transfer electrode from the transfer electrode charge supply means based on an inflow current flowing to the photoreceptor through the charge send/receive means and on an outflow current flowing from the photoreceptor through a ground wire connecting the photoreceptor and the ground.

With this arrangement, the quantity of electric charges to be supplied to the photoreceptor via the transfer electrode from the transfer electrode charge supply means is controlled based on the inflow current and on the outflow current. Accordingly, a variation of inflow current due to a variation of image density of an original document can be controlled, thereby realizing a stable image transfer without a possibility of partial incapability or deterioration of image transfer.

The above and other objects, features and advantages of the present invention will become more apparent upon a reading of the following detailed description and drawings.

DETAILED DESCRIPTION OF THE INVENTION

Hereinafter, preferred embodiments of an image forming apparatus according to this invention are described with reference to the accompanying drawings. It should be noted that the embodiment described herein is one of the examples embodying the present invention and does not limit the scope of technology of the invention.

Figure 1:
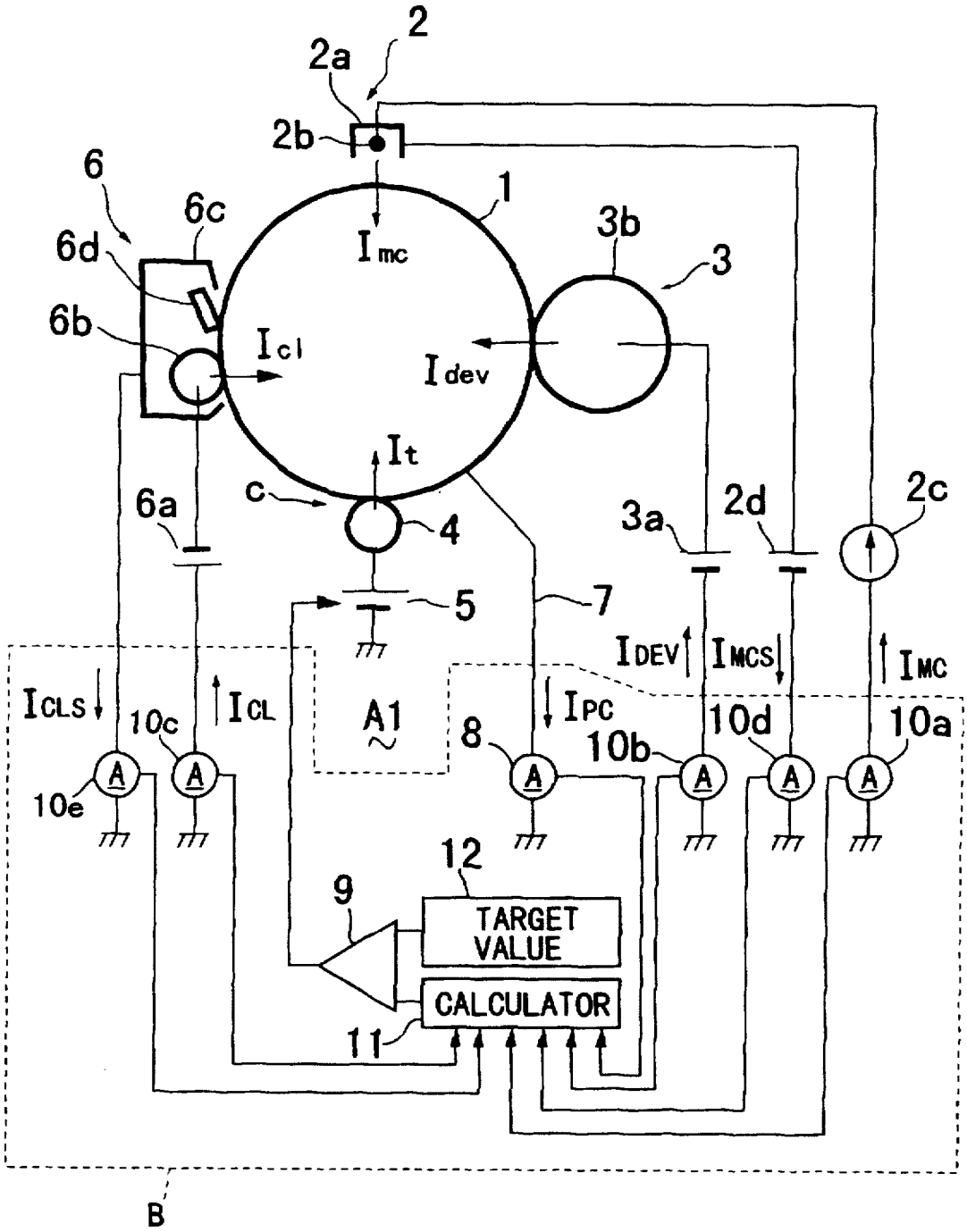
FIG. 1 is a diagram showing an arrangement of a first embodiment of an image forming apparatus according to this invention.

FIG. 1 is a diagram showing an image forming apparatus as a first embodiment of this invention.

Reference numeral A1 denotes the image forming apparatus. The image forming apparatus A1 comprises a main charger 2, a developing unit 3, a transfer unit C, a cleaning unit 6, a ground wire 7 for connecting a photoreceptor 1 to the ground, photoreceptor outflow current detector means 8, and transfer current controlling means 9. The transfer unit C includes a transfer roller 4 (also referred to as a "transfer electrode") and a power supply (transfer electrode charge supply means) 5.

The main charger 2 includes a cross sectional U-shaped shielding electrode (casing member) 2*a*, a wire electrode (also simply referred to as an "electrode") made of a metallic material such as tungsten, a power supply 2*c* for applying a high voltage of several kilovolts to the wire electrode 2*b*, and a power supply 2*d* for applying a bias voltage to the casing member 2*a*. With this arrangement, the main charger 2 uniformly positively charges the surface of the photoreceptor 1.

The developing unit 3 includes a power supply 3*a* and a developing roller 3*b*, and is adapted for electrically attracting toner to an electrostatic latent image that has been formed on the uniformly charged photoreceptor surface by projection of modulated light based on image data to develop the latent image to a toner image.

The transfer unit C is arranged at an appropriate position on an outer circumference of the photoreceptor 1 to transfer the toner image onto a copy sheet being transported to the surface the photoreceptor 1 by the transfer roller 4. The power supply 5 of the transfer unit C is adapted for applying a certain voltage to the transfer roller 4 i.e., supplying electric charges thereto so as to electrically attract toner of the toner image onto the copy sheet.

The cleaning unit 6 includes a shielding electrode (casing member) 6c, a cleaning roller (electrode) 6b, a power supply 6a for applying a voltage to the cleaning roller 6b, and a brush 6d. With this arrangement, the cleaning unit 6 removes toner residues on the surface of the photoreceptor 1 after the image transfer.

The photoreceptor outflow current detector means 8 detects a photoreceptor outflow current $I_{PC}$ flowing from the photoreceptor 1 to the ground wire 7. The transfer current controlling means 9 controls the output of the power supply 5 to maintain the level of current $I_t$ derived in the transfer unit C (hereinafter merely referred to as a "transfer current") by in and out flow of electric charges (inflow and outflow of current) in the transfer unit C within a predetermined range, based on a calculation result by a calculating circuit 11 which is described later in detail.

The image forming apparatus A1 further comprises a main charger current detector means 10a for detecting a current (or main charger current) $I_{MC}$ flowing through the wire electrode 2b of the main charger 2, a developing current detector means 10b for detecting a current (or developing current) $I_{DEV}$ flowing through the developing roller 3b of the developing unit 3, a cleaning current detector means 10c for detecting a current (or cleaning current) $I_{CL}$ flowing through the cleaning roller 6b of the cleaning unit 6, a main charger shield current detector means 10d for detecting a current (or main charger shield current) $I_{MCS}$ flowing through the shielding electrode 2a of the main charger 2, and a cleaning shield current detector means 10e for detecting a current (or cleaning shield current) $I_{CLS}$ flowing through the shielding electrode 6c of the cleaning unit 6. The image forming apparatus A1 further comprises the calculating circuit (current inflow/outflow summation means) 11 for summing up the current flowing in and out of the photoreceptor 1, and an ROM 12 in which a predetermined target value for controlling output of the power supply 5 is stored in advance.

The main charger 2, the developing unit 3, and the cleaning unit 6 constitute charge SND/RCV means for sending and receiving electric charges to and from the photoreceptor 1. The charge SND/RCV means is charger means other than the transfer unit C.

The photoreceptor outflow current detector means 8, the transfer current controlling means 9, the current detector means 10a to 10e, the summation means (or calculator) 11 and the ROM 12 constitute control means B.

The photoreceptor 1 is grounded via the ground wire 7. With this arrangement, when a high voltage is applied to the wire electrode 2b by the power supply 2c, corona discharge generates between the wire electrode 2b and the photoreceptor 1 to positively uniformly charge the surface of the photoreceptor 1. Since a bias voltage is applied to the casing member (shielding electrode) 2a by the power supply 2d, the corona discharge generates over a drum forming the surface of the photoreceptor 1.

When the surface of the uniformly charged photoreceptor 1 is exposed to projection of light that has been modulated based on image data, the electric resistance on the photoreceptor surface at the exposed area varies to form an electrostatic latent image on the surface of the photoreceptor 1.

In the developing unit 3, negatively charged toner, use of electric charges from the power supply 3a is attracted to the latent image formed on the photoreceptor surface by the developing roller 3b to develop the latent image into a toner image.

A copy sheet transported to the transfer unit C is charged via the transfer roller 4 with electric charges the power supply 5 to electrically attract the toner of the toner image thereto.

After the image transfer, i.e., the copy sheet carrying the transferred toner image has passed the transfer unit C, toner residues on the photoreceptor surface are mechanically removed with the aid of the brush 6d and electrically removed by the cleaning roller 6b charged by application of a voltage by the power supply 6a.

Next, a control operation by the control means B is described with reference to FIG. 1.

As shown in FIG. 1, the value of the main charger current $I_{MC}$ detected by the current detector means 10a, the developing current $I_{DEV}$ detected by the current detector means 10b, the cleaning current $I_{CL}$ detected by the current detector means 10c, the main charger shield current $I_{MCS}$ detected by the current detector means 10d, and the cleaning shield current $I_{CLS}$ detected by the current detector means 10e are inputted to the calculating circuit 11.

The calculating circuit 11 calculates:

the main charger inflow current $I_{mc}$ flowing from the main charger 2 to the photoreceptor 1 by EQ. (1);

the developing inflow current $I_{dev}$ flowing from the developing unit 3 to the photoreceptor 1 by EQ. (2); and the cleaning inflow current $I_{cl}$ flowing from the cleaning unit 6 to the photoreceptor 1 by EQ. (3), $$I_{mc}=I_{MC}-I_{MCS} \quad \text{EQ(1)}$$

$$I_{dev}=I_{DEV} \quad \text{EQ(2)}$$

$$I_{cl}=I_{CL}-I_{CLS} \quad \text{EQ(3)}$$

In this way, the photoreceptor inflow currents $I_{mc}$, $I_{dev}$, and $I_{cl}$ are respectively calculated.

The value of photoreceptor outflow current $I_{PC}$ detected by the photoreceptor outflow current detector means 8 is also inputted to the calculating circuit 11.

Since the sum of currents flowing to the photoreceptor 1 is equal to the sum of current flowing out of the photoreceptor 1, i.e., outflow current $I_{pc}$, the following EQ. (4) is obtained:

$$I_{PC}=I_t+I_{mc}+I_{dev}+I_{cl} \quad \text{EQ(4)}$$

Using EQ (4), the transfer current $I_t$ is then calculated by EQ. (5) as follows:

$$I_t=I_{PC}-(I_{mc}+I_{dev}+I_{cl}) \quad \text{EQ(5)}$$

The transfer current controlling means 9 compares the transfer current $I_t$ obtained from EQ. (5) with the predetermined target value stored in the ROM 12 to control the output of the power supply 5 so as to maintain the transfer current $I_t$ within a permissible range including the target value.

In this way, the image forming apparatus A1 is operated such that the transfer current $I_t$ is calculated based on the summation of current flowing in and out of the photoreceptor 1 as a whole. Accordingly, the variation of transfer current $I_t$ can be detected with high accuracy despite the variation of other inflow currents such as $I_{dev}$ and $I_{cl}$ due to variation of image density of an original document. The transfer current $I_t$ can be maintained within the permissible range by feedback controlling the output of the power supply 5. As a result, it can prevent occurrence of partial image transfer incapability or deteriorated image transferability and realize stable image transfer.

According to this embodiment, the currents flowing to the shielding electrodes 2a and 6c are respectively detected by the detector means 10a and 10e. Accordingly, even if the potential level of the main charger 2 and the cleaning unit 6 fluctuate due to smear of the electrodes 2*a* and 6*c* and the like, the level of inflow currents $I_{mc}$ and $I_{cl}$ can be adjusted individually to continuously perform stable image transfer even if various conditions for desirable image transfer are changed as time goes by.

Figure 2:
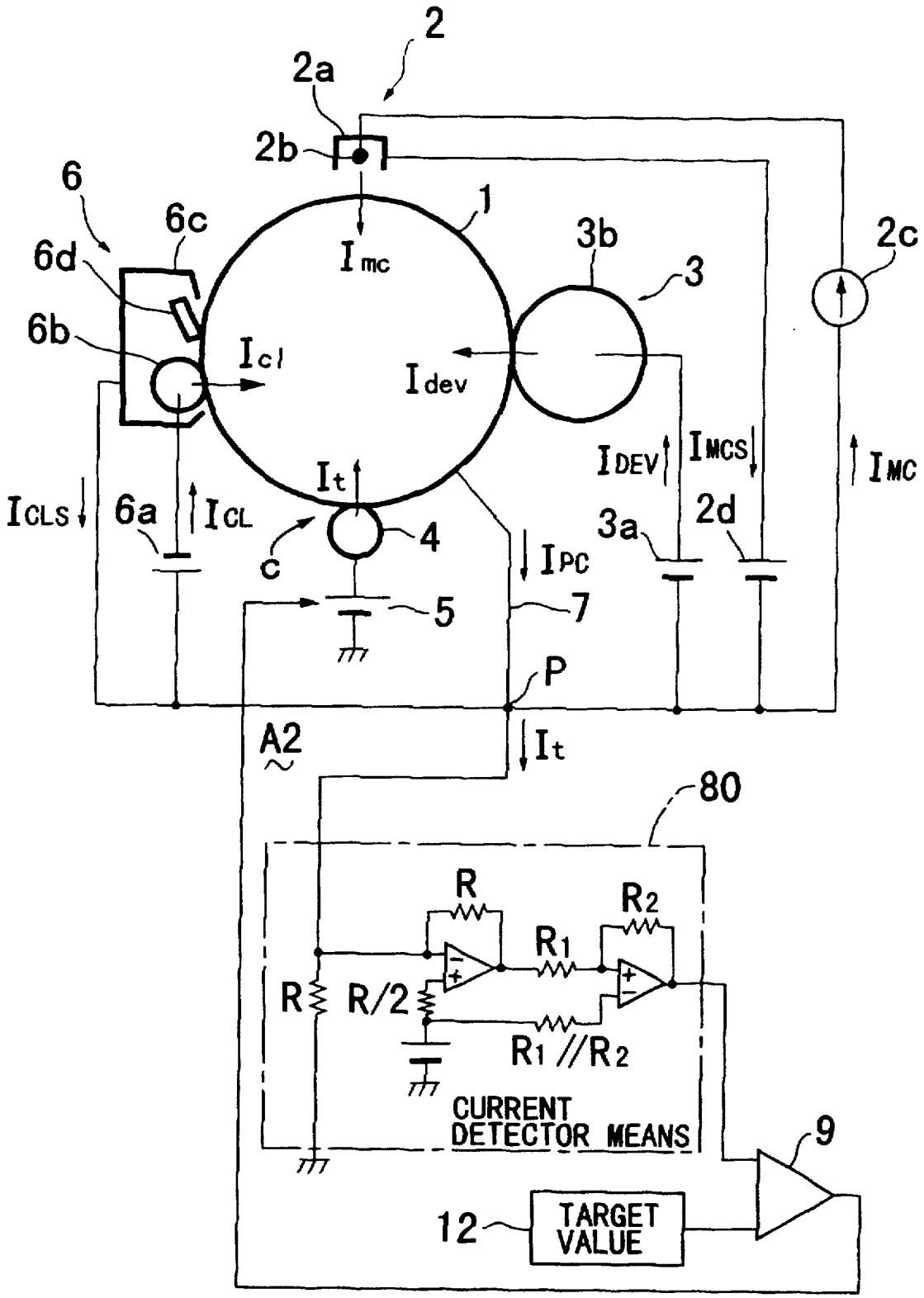
FIG. 2 is a diagram showing an arrangement of a second embodiment of an image forming apparatus according to this invention.
Figure 3:
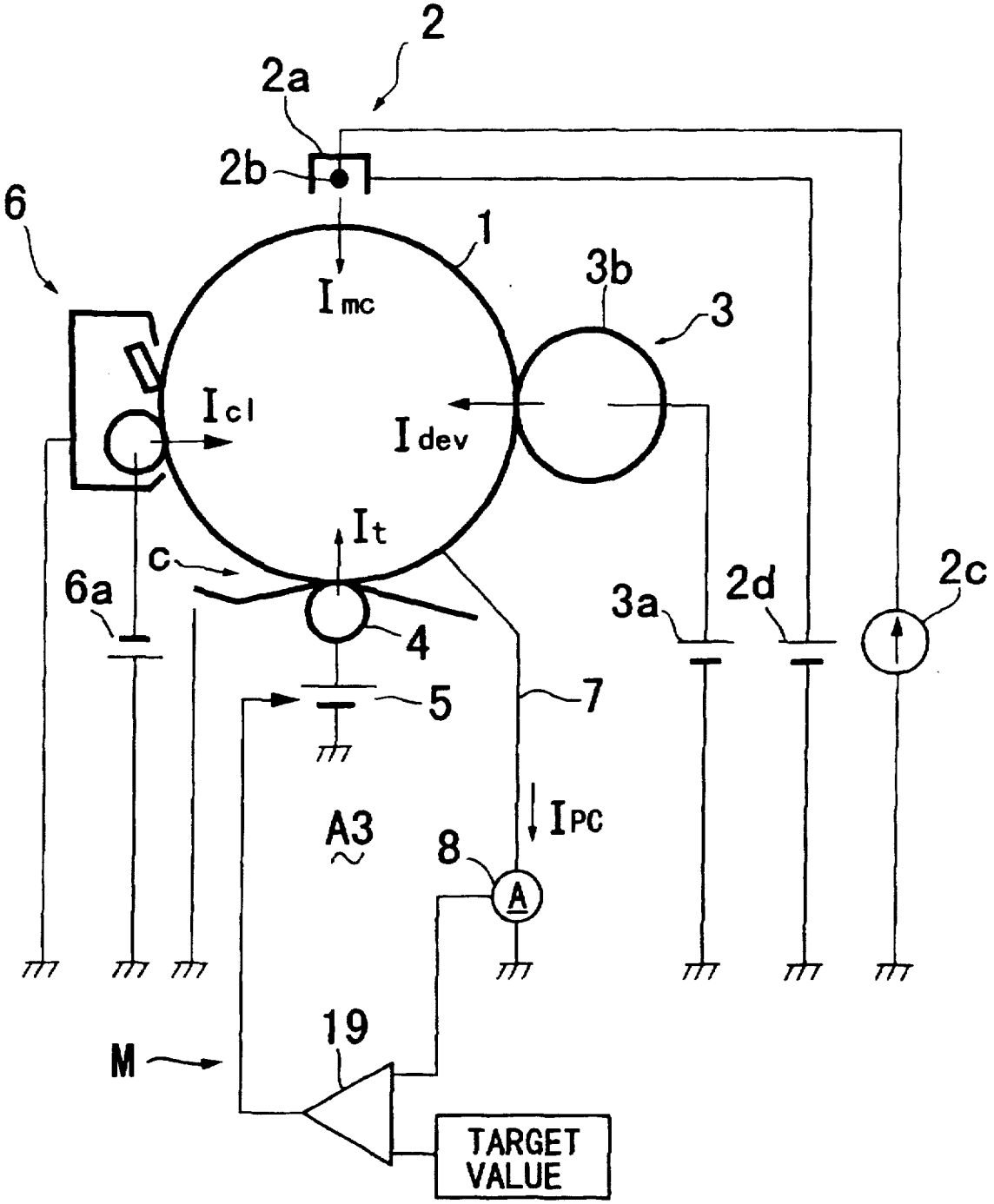
FIG. 3 PRIOR ART
FIG. 3 is a schematic diagram showing an image forming apparatus of prior art.

Next, an image forming apparatus as a second embodiment of this invention is described with reference to FIG. 2. It is to be noted that the same elements as those in the first embodiment are denoted at the reference numerals identical to those in the first embodiment, and the description thereof is omitted herein.

The image forming apparatus A2 of this embodiment comprises a main charger 2, a developing unit 3, a transfer unit C, a cleaning unit 6, a ground wire 7, current detector means 80, and transfer current controlling means 9. The transfer unit C has a transfer roller 4 and a power supply 5. The main charger 2, the developing unit 3, and the cleaning unit 6 constitute charge SND/RCV means for sending and receiving electric charges to and from the photoreceptor 1. The charge SND/RCV means are charger means other than the transfer unit C.

Unlike the arrangement of the image forming apparatus A1 in which the terminal of the main charger 2, the developing unit 3, and the cleaning unit 6 is grounded via the current detector means 10*a* to 10*e*, the image forming apparatus A2 is not incorporated with the current detector means 10*a* to 10*e* terminals of the main charger 2, the developing unit 3, and the cleaning unit 6 are connected to the ground wire 7 at the point P between the photoreceptor 1 and the current detector means 80.

With this arrangement, the photoreceptor outflow current $I_{PC}$ is branched into inflow currents $I_{dev}$, $I_{mc}$, and $I_{cl}$ at the point P. As a result, the level of current $I_t$ detected by the current detector means 80 corresponds to that of the transfer current $I_t$ represented by EQ. (5) shown in the section of the first embodiment.

The transfer current controlling means 9 controls the output of the power supply 5 based on the transfer current $I_t$ detected by the current detector means 80 to control the transfer current $I_t$ within the permissible range including the target value stored in an ROM 12.

According to the second embodiment, the terminals of the main charger 2, the developing unit 3, and the cleaning unit 6 are connected to the ground wire 7 at the point P between the photoreceptor 1 and the current detector means 80. Thereby, similar to the first embodiment, the output of the power supply 5 can be controlled to maintain the transfer current within the predetermined range.

Further, the second embodiment omits the calculating circuit for summing up the current flowing in and out of the photoreceptor 1 as a whole. Accordingly, the number of parts constituting the apparatus can be greatly reduced, thereby reducing the production cost for the image forming apparatus A2.

The present invention is not limited to the foregoing embodiments, and can take the following modifications and alterations ① to ⑤.

Figure 4:
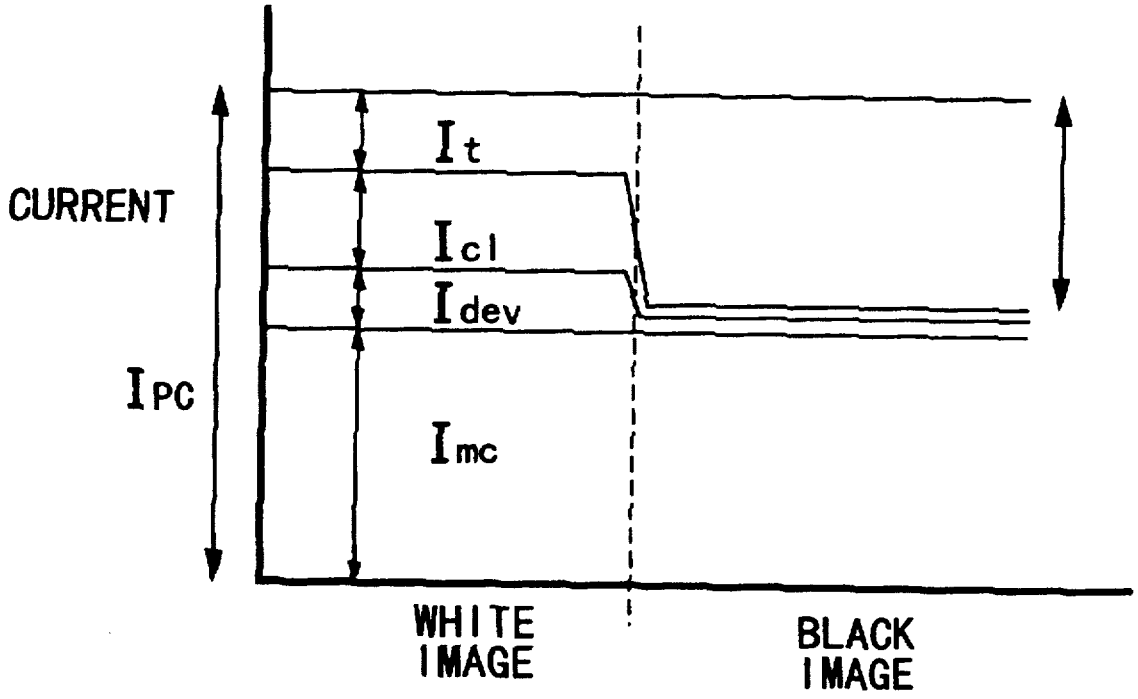
FIG. 4 PRIOR ART
FIG. 4 is a graph illustrating a drawback of transfer current control means provided in the conventional image forming apparatus.

① In the first embodiment, the variation of level of the inflow current $I_{mc}$ during image transfer is negligible in spite of the variation of image density (see FIG. 4). Accordingly, the current detector means 10*a* can be omitted.

In this case, since the value of $I_{mc}$ is no longer included on the right side of EQ. (5), the transfer current $I_t$ obtained by EQ. (5) becomes larger by the value of $I_{mc}$. It may be preferable, accordingly, to adjust the target value stored in the ROM 12 in advance so as to compensate for this value.

② In place of the first embodiment in which each of the main charger 2, the developing unit 3, and the cleaning unit 6 constituting the charge SND/RCV means is provided with current detector means, the current detector means may be provided for at least one of these charge SND/RCV means. In this alteration, also, the transfer current $I_t$ can be more accurately detected, and the output of the power supply 5 can be properly controlled, compared to the conventional arrangement. In this alteration, the target value in the ROM 12 may be set according to which charge SND/RCV means the current detector means is provided for.

③ In the second embodiment, the main charger 2, the developing unit 3, and the cleaning unit 6 each of which constitutes the charge SND/RCV means are all connected to the ground wire at the point P. In place of this arrangement, at least one of the charge SND/RCV means may be connected to the ground wire. In this modification, also, the transfer current $I_t$ can be detected more accurately, and the output of the power supply 5 can be more properly controlled, compared to the conventional arrangement. In this modification, the target value in the ROM 12 may be set according to which charge SND/RCV means the ground wire is connected at the point P.

④ The potential level of the outflow current detector means 8 on the ground side in the first embodiment, and the potential level of the current detector means 80 on the ground side in the second embodiment are not necessarily set at 0V but may preferably be set at a predetermined constant value.

⑤ The expression that "current flows in and out of the photoreceptor 1" or "inflow and outflow of current flowing in and out of the photoreceptor 1" is used throughout the first and second embodiments. However, this expression is used merely for easier understanding of this invention. The actual flow of current should not necessarily be in conformity with the state described by this expression, and any direction of current flow is admitted as long as the output of the power supply 5 can be controlled based on the summation of current flowing in and out throughout the photoreceptor 1 to control the level of transfer current.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An image forming apparatus with a transfer unit for transferring toner electrically attracted to an electrostatic latent image formed on a photoreceptor onto a copy sheet, the image forming apparatus comprises:

the transfer unit including a transfer electrode;

a ground wire connecting the photoreceptor to ground for carrying an outflow current;

charge send/receive means, other than the transfer unit and the ground wire, for sending and receiving electric charges to and from the photoreceptor and thereby providing an inflow current to the photoreceptor;

a transfer electrode charge supply means for supplying electric charges to the transfer electrode to electrically attract the toner onto the copy sheet; and control means for controlling electric charges supplied to the photoreceptor, via the transfer electrode, from the transfer electrode charge supply means based on:

the inflow current flowing to the photoreceptor through the charge send/receive means; and the outflow current flowing from the photoreceptor through the ground wire connecting the photoreceptor to the ground.

2. The image forming apparatus according to claim 1, wherein the control means controls a transfer current comprised of the electric charges exchanged between the transfer electrode and the photoreceptor to maintain the transfer current within a predetermined range based on the inflow current and the outflow current.

3. The image forming apparatus according to claim 1, wherein the control means includes:

photoreceptor outflow current detector means in a path of the ground wire for detecting the outflow current;

photoreceptor inflow current detector means for detecting the inflow current; and current inflow/outflow summation means for summing up the inflow current and the outflow current flowing to and from the photoreceptor based on measurement results of the outflow current detector means and the inflow current detector means, a quantity of the electric charges supplied to the photoreceptor via the transfer electrode being controlled based on a calculation result of the summation means.

4. The image forming apparatus according to claim 1, further comprising:

a main charger for uniformly charging a surface of the photoreceptor, a developing unit for electrically attracting toner to the electrostatic latent image to form a transferred toner image, and a cleaning unit for removing toner residues on the surface of the photoreceptor after the copy sheet with the transferred toner image thereon has passed the transfer unit; and wherein at least one of the main charger, the developing unit, and the cleaning unit is included in the charge send/receive means.

5. The image forming apparatus according to claim 4, wherein the charge send/receive means includes at least one of the main charger and the cleaning unit, and said at least one of the main charger and the cleaning unit has an electrode for receiving voltage and a casing member for shielding the electrode, and the control means controls the electric charges supplied to the photoreceptor via the transfer electrode based on the inflow current wherein the inflow current includes currents of the electrode and to the casing member.

6. The image forming apparatus according to claim 1, wherein the control means includes current detector means in a path of the ground wire for detecting a current flowing to the ground, and the charge send/receive means is connected to the ground wire a junction between the photoreceptor and the current detector means, whereby the inflow current and the outflow current are summed at the junction.

7. The image forming apparatus according to claim 6, further comprising: a main charger for uniformly charging a surface of the photoreceptor, a developing unit for electrically attracting toner to the electrostatic latent image to form a transferred toner image, and a cleaning unit for removing toner residues on the surface of the photoreceptor after the copy sheet with the transferred toner image thereon has passed the transfer unit and wherein at least one of the main charger, the developing unit, and the cleaning unit is included in the charge send/receive means.

8. The image forming apparatus according to claim 7, wherein the charge send/receive means includes at least one of the main charger and the cleaning unit, and said at least one of the main charger and the cleaning unit has an electrode for receiving voltage and a casing member for shielding the electrode, and the electrode and the casing member are respectively connected to the ground wire at the junction between the photoreceptor and the current detector means.

9. A method for forming an image on a copy sheet with a transfer unit by transferring toner electrically attracted to an electrostatic latent image formed on a photoreceptor on the copy sheet, the method comprising the steps of:

measuring an inflow current flowing to the photoreceptor through charge send/receive means and an outflow current flowing from the photoreceptor through a ground wire connecting the photoreceptor to ground, wherein the charge send/receive means excludes the transfer unit and the ground wire and is for sending and receiving electric charges to and from the photoreceptor; and controlling a quantity of electric charges supplied to the photoreceptor via a transfer electrode in the transfer unit based on measurement results of the above step.

10. The image forming method according to claim 9, further comprising the step of measuring the inflow current and the outflow current includes determining a transfer current resulting from sending and receiving the electric charges between the transfer electrode and the photoreceptor based on the measurement results of the inflow current and the outflow current and wherein the controlling step controls the quantity of electric charges supplied to the photoreceptor via the transfer electrode by setting a level of the transfer current to within a predetermined range.

11. An image forming apparatus with a transfer unit for transferring toner electrically attracted to an electrostatic latent image formed on a photoreceptor onto a copy sheet, the image forming apparatus comprises:

the transfer unit including a transfer electrode;

a ground wire connecting the photoreceptor to ground for carrying an outflow current;

charge send/receive means, other than the transfer unit and the ground wire, for sending and receiving electric charges to and from the photoreceptor and thereby providing an inflow current to the photoreceptor;

a transfer electrode charge supply means for supplying electric charges to the transfer electrode to electrically attract the toner onto the copy sheet; and control means for controlling a transfer current applied to the transfer electrode from the transfer electrode charge supply means for supplying electric charges to the photoreceptor, via the transfer electrode, the transfer current being controlled based on:

the inflow current flowing to the photoreceptor through the charge send/receive means; and the outflow current flowing from the photoreceptor through the ground wire connecting the photoreceptor to the ground.

12. The image forming apparatus according to claim 11, wherein the control means controls the transfer current to maintain the transfer current within a predetermined range based on the inflow current and the outflow current.

13. The image forming apparatus according to claim 11, wherein the control means includes:

photoreceptor outflow current detector means in a path of the ground wire for detecting the outflow current;

photoreceptor inflow current detector means for detecting the inflow current;

current inflow/outflow summation means for summing up the inflow current and the outflow current flowing to and from the photoreceptor based on measurement results of the outflow current detector means and the inflow current detector means; and the transfer current being controlled based on a calculation result of the summation means.

14. The image forming apparatus according to claim 11, further comprising:

a main charger for uniformly charging a surface of the photoreceptor, a developing unit for electrically attracting toner to the electrostatic latent image to form a transferred toner image, and a cleaning unit for removing toner residues on the surface of the photoreceptor after the copy sheet with the transferred toner image thereon has passed the transfer unit; and wherein at least one of the main charger, the developing unit, and the cleaning unit is included in the charge send/receive means.

15. The image forming apparatus according to claim 14, wherein the charge send/receive means includes at least one of the main charger and the cleaning unit, and said at least one of the main charger and the cleaning unit has an electrode for receiving voltage and a casing member for shielding the electrode, and the control means controls the transfer current based on the inflow current wherein the inflow current includes currents of the electrode and to the casing member.

16. The image forming apparatus according to claim 11, wherein the control means includes current detector means in a path of the ground wire for detecting a current flowing to the ground, and the charge send/receive means is connected to the ground wire a junction between the photoreceptor and the current detector means, whereby the inflow current and the outflow current are summed at the junction.

17. The image forming apparatus according to claim 16, further comprising:

a main charger for uniformly charging a surface of the photoreceptor, a developing unit for electrically attracting toner to the electrostatic latent image to form a transferred toner image, and a cleaning unit for removing toner residues on the surface of the photoreceptor after the copy sheet with the transferred toner image thereon has passed the transfer unit and wherein at least one of the main charger, the developing unit, and the cleaning unit is included in the charge send/receive means.

18. The image forming apparatus according to claim 17, wherein the charge send/receive means includes at least one of the main charger and the cleaning unit, and said at least one of the main charger and the cleaning unit has an electrode for receiving voltage and a casing member for shielding the electrode, and the electrode and the casing member are respectively connected to the ground wire at the junction between the photoreceptor and the current detector means.

* * * * *